US005291242A

United States Patent [19]

Takano

[11] Patent Number: 5,291,242

[45] Date of Patent: Mar. 1, 1994

[54] GEAR ARRANGEMENT FOR DEVELOPMENT UNIT OF IMAGING DEVICE

[75] Inventor: Masatoshi Takano, Akikawa, Japan

[73] Assignee: Asahi Kogaku Kogyo Kabushiki Kaisha, Tokyo, Japan

[21] Appl. No.: 918,042

[22] Filed: Jul. 24, 1992

[30] Foreign Application Priority Data

Jul. 25, 1991 [JP] Japan ..... 3-274422

[51] Int. Cl.[5] ..... G03G 15/06; G03G 21/00

[52] U.S. Cl. ..... 355/200; 355/245

[58] Field of Search ..... 355/200, 245, 246, 251, 355/253, 259

[56] References Cited

U.S. PATENT DOCUMENTS

| | | | |
|---|---|---|---|
| 4,615,605 | 10/1986 | Kida et al. | 355/245 X |
| 4,721,982 | 1/1988 | Ueda | 355/253 X |
| 4,814,816 | 3/1989 | Idenawa | 355/259 |
| 4,975,746 | 12/1990 | Miyauchi et al. | 355/245 |
| 4,989,037 | 1/1991 | Nagatsuna | 355/251 X |
| 4,993,356 | 2/1991 | Guslits | 355/245 X |
| 5,134,441 | 7/1992 | Nagata et al. | 355/245 |

*Primary Examiner*—Fred L. Braun

*Attorney, Agent, or Firm*—Sandler Greenblum & Bernstein

[57] ABSTRACT

A gear arrangement for a development unit of an imaging device employing an electrophotographic process. The development unit is provided with a rotation member and swingably supported by the main body of the imaging device through a support shaft to be mounted on a predetermined position of the main body of the imaging device. An input gear is provided on the development unit and coupled with the rotation member thereof to be meshed with a drive gear provided with the imaging device. The rotational force of the drive gear is transmitted to the input gear to thereby rotate the rotation member. The drive gear and the input gear are disposed such that a line obtained by extending a line of action as a moving locus of the point at which the tooth of the drive gear is in contact with the tooth of the input gear is substantially directed to the direction of the support shaft through which the development unit is supported by the main body of the imaging device.

2 Claims, 5 Drawing Sheets

GEAR ARRANGEMENT FOR DEVELOPMENT UNIT OF IMAGING DEVICE

BACKGROUND OF THE INVENTION

The present invention relates to a gear arrangement for a development unit of an imaging device employing an electrophotographic process.

Conventionally, gears are arranged such that an input gear coupled with a rotation member provided to the development unit meshes with a drive gear provided to the imaging device such that the development unit is swingably supported by the main body of the imaging device through a support shaft and mounted to a predetermined position of the main body, and the rotation of the drive gear is transmitted to the input gear to thereby rotate the rotation member.

Conventionally known are imaging devices such as an electronic copy machine, laser beam printer and the like which make use of the electrophotographic process.

Although various systems can be contemplated to develop images in the electrophotographic process, a system referred to as a magnetic brush method is generally employed, wherein charged toner is supplied to an electrostatic latent image by a magnetic material carrier (magnetic brush) arranged as a chain by a magnet.

The magnetic brush method employs a two-component developer composed of non-magnetic toner mixed with a magnetic material carrier at a preset ratio. Recently, however, a system of using a single-component charged type magnetic toner and a development roller to which a magnetic material carrier is predeposited is also employed by the method.

A development unit to which the aforesaid magnetic brush method is applied is provided with a development roller which is composed of a magnetic roller and a sleeve of a non-magnetic material rotatably inserted around the periphery of the magnetic roller, and toner is sequentially supplied to a development area by the rotation of the sleeve of the development roller.

To stably perform a development operation by the arrangement described above, a gap (development gap) between the circumferential surface of the development roller and the circumferential surface of a photoconductive drum must be set with a pinpoint accuracy. For this purpose, conventionally, guide rollers each having a radius obtained by adding the development gap to be set to the radius of the development roller are rotatably disposed on the opposite ends of the development roller, and the development gap is set at a pinpoint accuracy by causing the guide rollers to be abutted against the circumferential surface of the photoconductive drum. The development unit is swingably mounted to the main body of an imaging unit through a support shaft, so that it can be moved in the direction along which the development roller approaches and retracts from the photoconductive drum.

A rotating force, for rotating the development roller, is transmitted in such a manner that an input gear coupled with the development roller meshes with the drive gear provided to the main body of the imaging device, so that the development unit is set at a predetermined position with respect to the main body of the imaging device. A drive force transmission mechanism composed of the input gear and drive gear need only be provided at one end of the development unit, from the view point of the function thereof.

Nevertheless, with the above arrangement, a problem arises in that the development unit is swung by the rotational torque of the drive gear, and when the drive force transmission mechanism is provided on only one end of the development unit, an urging force for pressing the development roller against the photoconductive drum (i.e., a pressing force for causing the guide rollers to be abutted against the circumferential surface of the photoconductive drum) is slightly different between the right end and the left end of the photoconductive drum. Thus a recording paper is irregularly developed in the width direction of the paper.

This problem can be solved by providing drive force transmission mechanism at both the right and left ends of the development roller (providing drive gears and input gears at the opposite ends) so that a change in a force for pressing the development roller caused by a drive torque being transmitted is made uniform on the right and left sides of the development roller. In this case, however, cost is increased because the structure is made to be more complex. Further, a change in the force for pressing the development roller against the photoconductive drum is not desirable, even if the force is uniformly changed at the right and left ends of the development roller.

SUMMARY OF THE INVENTION

It is therefore an object of the present invention to provide an improved gear arrangement for a development unit by which a change of a force for pressing a development roller against a photoconductive drum caused by a drive torque transmitted from a drive force transmission mechanism can be prevented.

To accomplish the above propose, according to the present invention, a gear arrangement for a development unit of an imaging device employing an electrophotographic process is provided, wherein the development unit is provided adjacent a rotation member and swingably supported by the main body of the imaging device through a support shaft to be mounted on a predetermined position of the main body of the imaging device. An input gear is provided to the development unit and coupled to the rotation member thereof and meshed with a drive gear provided to the imaging device. The rotational force of the drive gear transmits to the input gear to thereby rotate the rotation member. The drive gear and the input gear are disposed such that a line obtained by extending a line of action as a moving locus of the point at which the tooth of the drive gear is in contact with the tooth of the input gear is substantially directed to the direction of the support shaft through which the development unit is supported by the main body of the imaging device.

According to the above arrangement, since a force acting on the development unit due to a drive torque transmitted from the drive force transmission mechanism acts in the direction of the support shaft mounted to the main body of the imaging device, this force does not swing the development unit. Thus, and force for pressing the development roller against the photoconductive drum is not changed by the transmitted drive torque.

DESCRIPTION OF THE ACCOMPANYING DRAWINGS

DESCRIPTION OF THE EMBODIMENTS

An embodiment of the present invention will be described below with reference to the attached drawings.

Figure 1:
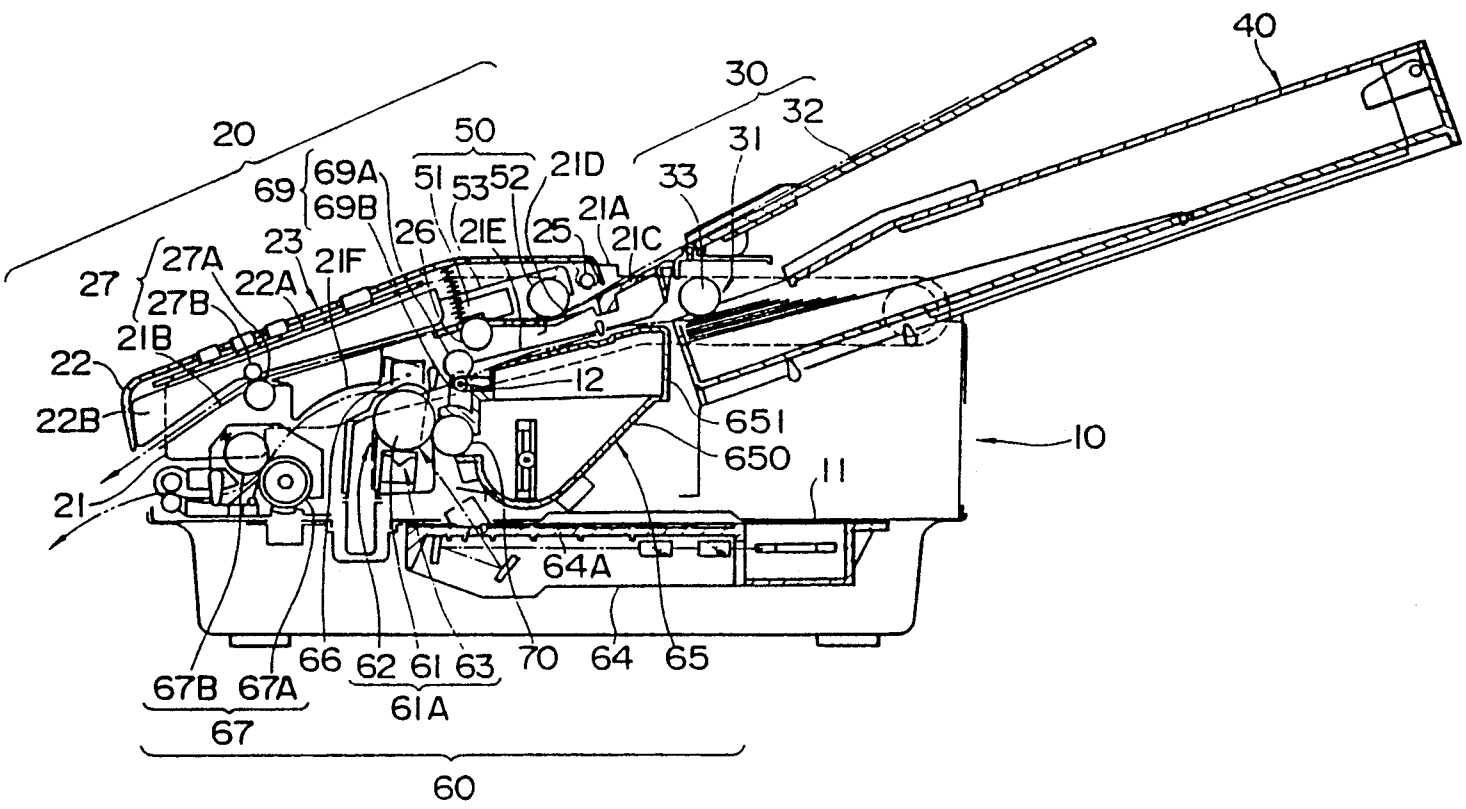
FIG. 1 is a schematic longitudinal cross sectional view of an electrophotographic facsimile device to which an embodiment of a gear arrangement for a development unit according to the present invention is applied.

FIG. 1 is a schematic longitudinal cross sectional view of an electrophotographic facsimile device to which an embodiment of a gear arrangement for a development unit according to the present invention is applied, wherein the left side corresponds to the front side of the device.

As shown in FIG. 1, the facsimile device includes a main body 10 and an upper composition 20, as a member covering the front upper portion of the main body 10. A paper feed unit 30 is disposed on the upper rear portion of the main body 10 for feeding or introducing recording papers on which received information is to be recorded and documents from which information to be transmitted is read to the device.

The upper surface of the upper composition 20 gradually declines toward the front end of the device, and an operation unit 23 including a display panel, operation buttons and the like is disposed thereon.

A reading head 50 is contained in the upper composition 20. A document to be transmitted is fed from the paper feed unit 30 through the upper composition 20, and the information recorded on the document is read by the reading head 50.

A recording unit 60 provided with various operation mechanisms for an electrophotographic process are accommodated in the main body 10 and the recording papers to which received information is to be output are fed from the paper feed unit 30, between the main body 10 and the upper composition 20, to the recording unit 60 where the received information is recorded onto them by the recording unit 60.

The respective units will be sequentially described in detail below.

The paper feed unit 30 is composed of a cassette mounting unit 31 having a recording paper cassette 40 detachably mounted to the recording paper introduction position of the paper feed unit 30 and a document holder 32, for documents to be transmitted, located at the front edge (right side in FIG. 2) of the cassette mounting unit 31. Cassette 40 contains recording papers onto which received information is recorded.

The cassette mounting unit 31 has a recording paper introduction roller 33 disposed at the position corresponding to the upper extreme end of the recording papers contained in the recording paper cassette 40, mounted to the cassette mounting unit 31. The recording paper introduction roller 33 is rotated by a drive motor (not shown).

The upper composition 20 is composed of an arm 21A and an operation panel 22. The arm 21A extends from a panel frame 21 as the framework of the upper composition 20 toward the rear end of the device and is swingably supported by a swing shaft 11 located at the upper rear portion of the main body 10. The operation panel 22 constitutes the upper surface of the upper composition 20 and is swingably supported by a pin 25 at the end of the upper composition 20 on the paper feed unit 30 side. Therefore, in this arrangement, the upper composition 20 can be swingingly opened and closed together with the operation panel 22 and the operation panel 22 can be swingingly opened and closed independently of the upper composition 20.

An operation panel base plate 22A is attached to the operation panel 22 along the inside (lower side) thereof. An upper document guide plate 22B is disposed inwardly of the operation panel base plate 22A (the main body 10 side). The reading head 50 is disposed in close proximity to the document introduction side of the upper document guide plate 22B (the paper feed unit 30 side).

The reading head 50 includes a close contact type reading sensor 51 and a document introduction roller 52 each supported by a head frame 53. Operation panel 22 is swingably supported by the pin 25, by which the panel frame 21 is also supported, with the document introduction roller 52 located at the paper feed unit 30 side.

The panel frame 21 has a lower document guide plate 21B, feed roller 26 and lower introduction unit guide 21C. The lower document guide plate 21B is located at the position corresponding to the upper document guide plate 22B, the feed roller 26 is located at the position corresponding to the reading sensor 51 of the reading head 50, and the lower introduction unit guide 21C is located at the position corresponding to the reading head 50.

The rear end (adjacent to the paper feed unit 30) of the lower introduction unit guide 21C is formed as an inclined surface contiguous to the document holder 32 of the paper feed unit 30. A press and support plate 21D is disposed at the position corresponding to the document introduction roller 52 of the lower introduction unit guide 21C. The press and support plate 21D is pressed and urged against the document introduction roller 52 from the lower side thereof by an elastic return force.

Further, a pair of paper discharge rollers 27 are disposed substantially midway in the longitudinal direction of the lower document guide plate 21B and composed of a lower roller 27A slightly projecting above the upper surface of the lower document guide plate 21B and an upper roller 27B abutted against the projected upper surface of the lower roller 27A.

With the aforesaid arrangement of the operation panel 22 and panel frame 21, a document path is formed between the document guide member on the operation panel 22 side (the reading sensor 51 and upper document guide plate 22B) and the document guide member on the panel frame 21 side (the lower introduction unit guide 21C, press and support plate 21D and lower document guide plate 21B). The document introduction roller 52 of the reading head 50, the feed roller 26 of the panel frame 21, and the lower roller 27B of the pair of paper discharge rollers 27 are driven by a drive motor (not shown) at a predetermined circumferential speed. Consequently, a document placed on the document holder 32 is fed through the document path along a feed path shown by a dot-dash-line in FIG. 1 and information recorded on the document is recorded by being read by the reading head 50. More specifically, the document placed on the document holder 32 is introduced into the upper composition 20 by the document introduction roller 52 and the information recorded on the upper surface of the document is read by the reading sensor 51 while the document is being fed by the feed roller 26. Thereafter, the document is fed by the pair of discharge rollers 27 and discharged through the front end of the main body 10. Note, as described above, the reading head 50 is disposed above the document feed path in this arrangement and a document is placed on the document holder 32 with the information recorded surface thereof (the surface from which information is to be read) faced upward, and thus as the document is fed, the information is read and the document is discharged, in this state.

Further, the main body 10 includes the recording unit 60, which is provided with the various operation mechanisms for electrophotography, as described above.

More specifically, the recording unit 60 includes a cleaning mechanism 62 for cleaning toner remaining on the surface of a photoconductive material, a corona charger 63 for uniformly charging the photoconductive material on the surface of the photoconductive drum 61, a scanning optical system unit 64 for exposing and scanning the surface of the photoconductive drum 61 with a laser beam which is turned ON and OFF based on image information, a development unit 65 for forming a toner image by adhering toner to the portion of the photoconductive material where a latent image is formed by the removal of electric charge therefrom by exposure, a transfer charger 66 for transferring the toner image onto a recording paper by charging the recording paper, respectively, around the photoconductive drum 61 driven at a predetermined circumferential speed by a drive motor (not shown). Further, a fixing unit 67 is disposed at a position toward which the recording paper on which the toner image is transferred by the transfer charger 66 is fed.

The cleaning mechanism 62 includes a blade formed of an elastic member and abutted against the surface of the photoconductive drum 61, and is arranged as a photoconductive drum unit 61A, by being mounted on a single frame together with the photoconductive drum 61 and corona charger 63.

The development unit 65 includes housing 650 which has toner cartridge 651 detachably mounted thereon, a development roller 70 having a cylindrical sleeve into which a magnet roller is inserted and rotatably supported on one side in the forward and backward direction of the housing, and a mounting shaft 12 disposed substantially above the development roller 70 in parallel therewith. A roller 69B is rotatably inserted at the periphery of the mounting shaft 12. The development unit 65 is supported by the chassis of the main body 10 through the mounting shaft 12 and disposed with the development roller 70 located in close proximity to substantially the horizontal portion of the photoconductive drum 61 on the rear side of the device.

The scanning optical system unit 64 includes the respective components of the scanning optical system for scanning the surface of the photoconductive drum 61 with a laser beam which is turned ON and OFF based on image information. The aforementioned components are integrally arranged by being mounted on a unit frame 64A. Further, the scanning optical system unit 64 is mounted on the lower surface of a main body chassis 10A below the development unit 65 and paper feed unit 30 and a laser beam from the scanning optical system unit 64 passes between the corona charger 63 and the development unit 65 and is irradiated to the photoconductive drum 61 (for scanning the photoconductive drum 61).

The transfer charger 66 is supported above the photoconductive drum 61 by the panel frame 21 of the upper component 20.

The fixing unit 67 includes heat roller 67A, heated to a predetermined temperature, and a press roller 67B located obliquely upwardly of the heat roller 67A on the front end side of the device and pressed against the heat roller 67A, and fixed on the upper surface at a predetermined position of the main body chassis 10A. The heat roller 67A is rotated at a circumferential speed in synchronism with that of the photoconductive drum 61, and thus the fixing unit necessarily feeds a recording paper in addition to carrying out a fixing action.

Further, the inclined upper surface of the toner cartridge 651 of the development unit 65 is disposed in close proximity to the upper recording paper guide plate 21E disposed on the lower side of the lower introduction unit guide 21C of the panel frame 21 of the upper composition 20 with a predetermined space defined therebetween. A recording paper feed path regulation plate 21F disposed on the lower surface of the lower document guide plate 21B of the panel frame 21 is located at a position above and between the photoconductive drum 61 and the fixing unit 67, and formed in an arc shape directed from the transfer unit 66 toward the fixing unit 67 located obliquely downwardly of the transfer charger 66 on the front end side of the device.

Furthermore, a pair of rollers 69 includes the roller 69B, provided with the mounting shaft 12 of the development unit 65, and a feed roller 69A disposed on the upper composition 20 side. The feed roller 69A is driven by a drive motor (not shown) at the same circumferential speed as that of the photoconductive drum 61.

With the aforesaid arrangement of the recording unit 60 and upper composition 20, a recording paper feed path is formed between the recording paper guide member on the upper surface of the recording unit 60 (the upper surface of the toner cartridge 651) and the recording paper guide member on the lower surface of the upper composition 20 (the upper recording paper guide plate 21E and recording paper feed path regulation plate 21F). Recording papers accommodated in the recording paper cassette 40 mounted to the cassette mounting unit 31 of the paper feed unit 30 are fed through the recording paper path along a feed path shown by a two-dot-dash-line in FIG. 1 and received information is printed on the lower surface of each of the recording papers by the recording unit 60. More specifically, the recording papers accommodated in the recording paper cassette 40 are sequentially introduced into the recording paper path from the uppermost one thereof by the rotation of the recording paper introduction roller 33 of the cassette mounting unit 31, while the surface of the photoconductive drum 61 is main-scanned (exposed) in the rotational axis direction thereof with a laser beam modulated by received characters or image information and emitted from the scanning optical system unit 64. At the same time, the photoconductive drum 61 is rotated (sub-scanned), and the development unit 65 develops a latent image formed on the surface of the photoconductive drum 61 and forms a toner image. The thus obtained toner image is transferred onto the recording paper fed by the pair of drive rollers 69 at a speed in synchronism with the circumferential speed of the photoconductive drum 61 and charged by the transfer charger 66. Further, the toner image is fixed onto the recording paper by the fixing unit 67 and then the recording paper is discharged through the front end of the device.

Next, the development unit 65, to which the embodiment of the rotational force input gear arrangement structure according to the present invention is applied, will be described below in specific detail.

Figure 2:
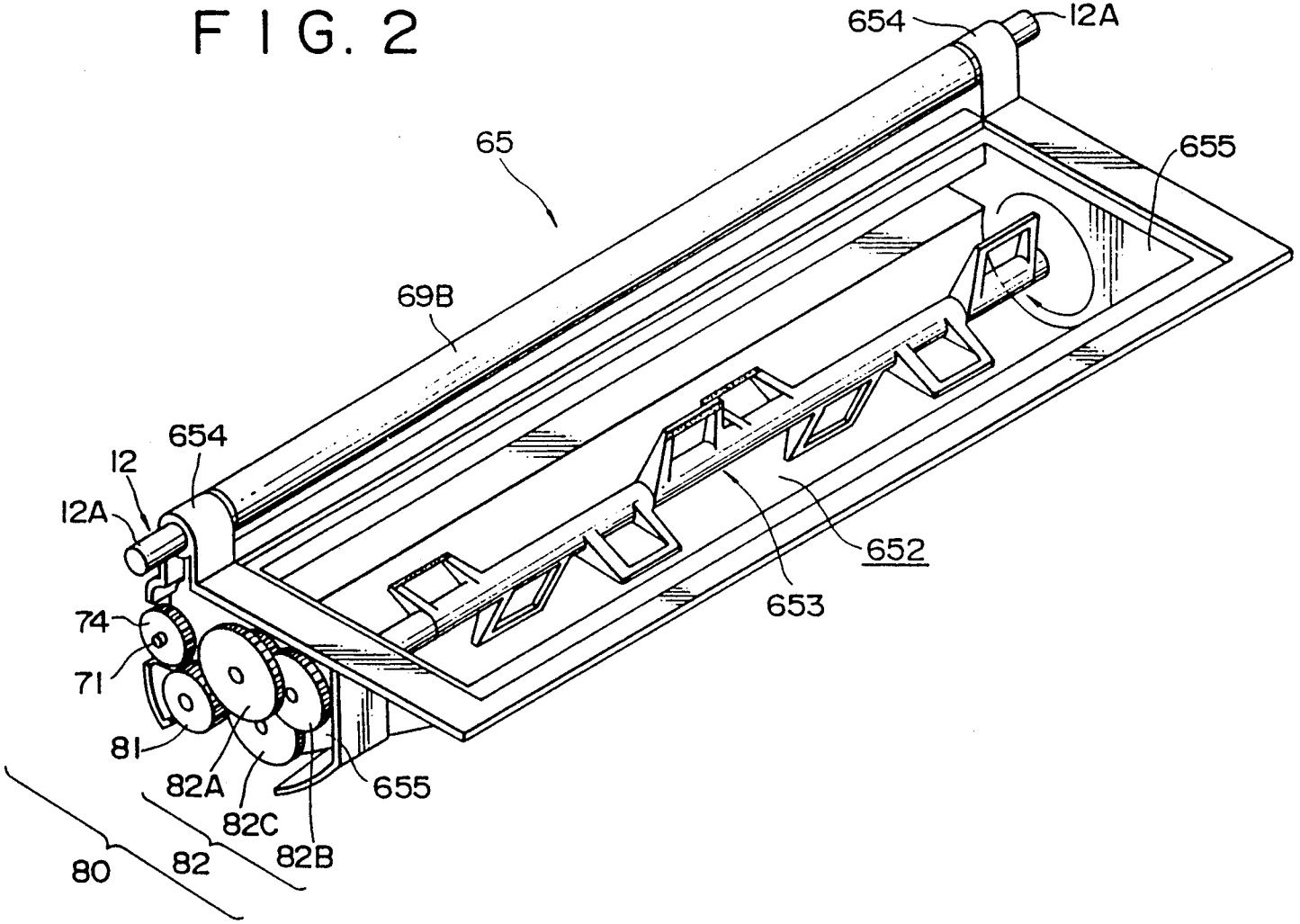
FIG. 2 is a perspective view of the development unit viewed from the rear side thereof.
Figure 3:
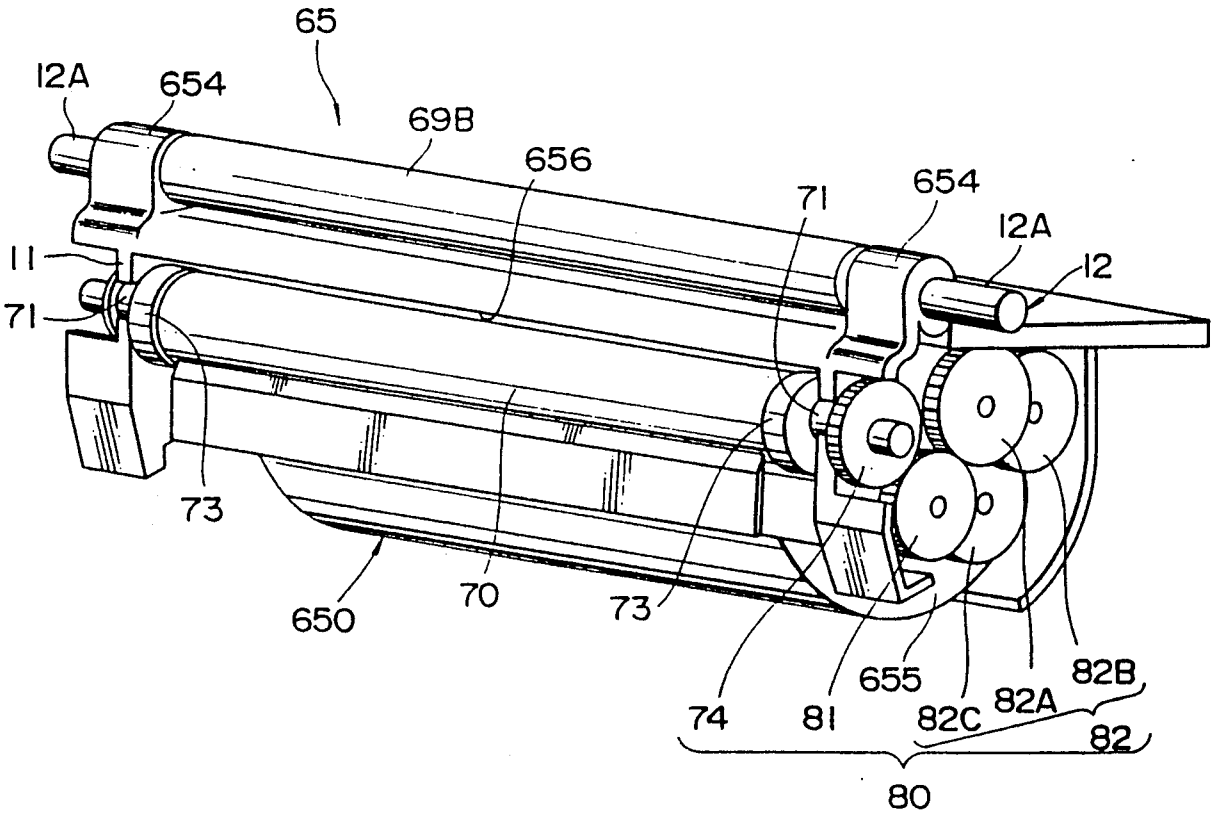
FIG. 3 is a perspective view of the development unit viewed from the front side thereof.

FIG. 2 is a perspective view of the development unit 65 viewed from the rear side thereof, and FIG. 3 is a perspective view of the development unit 65 viewed from the front side thereof. Note that the cartridge 651 described with reference to FIG. 1 is removed from the views shown in FIGS. 2 and 3.

The illustrated development unit 65 is arranged such that a toner accommodation vessel 652 is formed by a housing 650, the development roller 70 is disposed in the toner accommodation vessel 652 on one side thereof, and a scraper 653 is disposed substantially at the center of the toner accommodation vessel 652 for supplying toner accommodated therein to the development roller 70.

The aforesaid mounting shaft 12 is supported above the development roller 70 by supporting lugs 654, 654, projecting from the upper surface, at the opposite ends in the longitudinal direction of the housing 650. The opposite ends of the mounting shaft 12 project outwardly of the support lugs 654, 654 and serve as holding portions 12A, 12A.

The development unit 65 is supported by the chassis swingably about the mounting shaft 12 in such a manner that the holding portions 12A, 12A at the opposite ends of the mounting shaft 12 are placed in not shown upwardly-open cutouts formed in the chassis.

Figure 5:
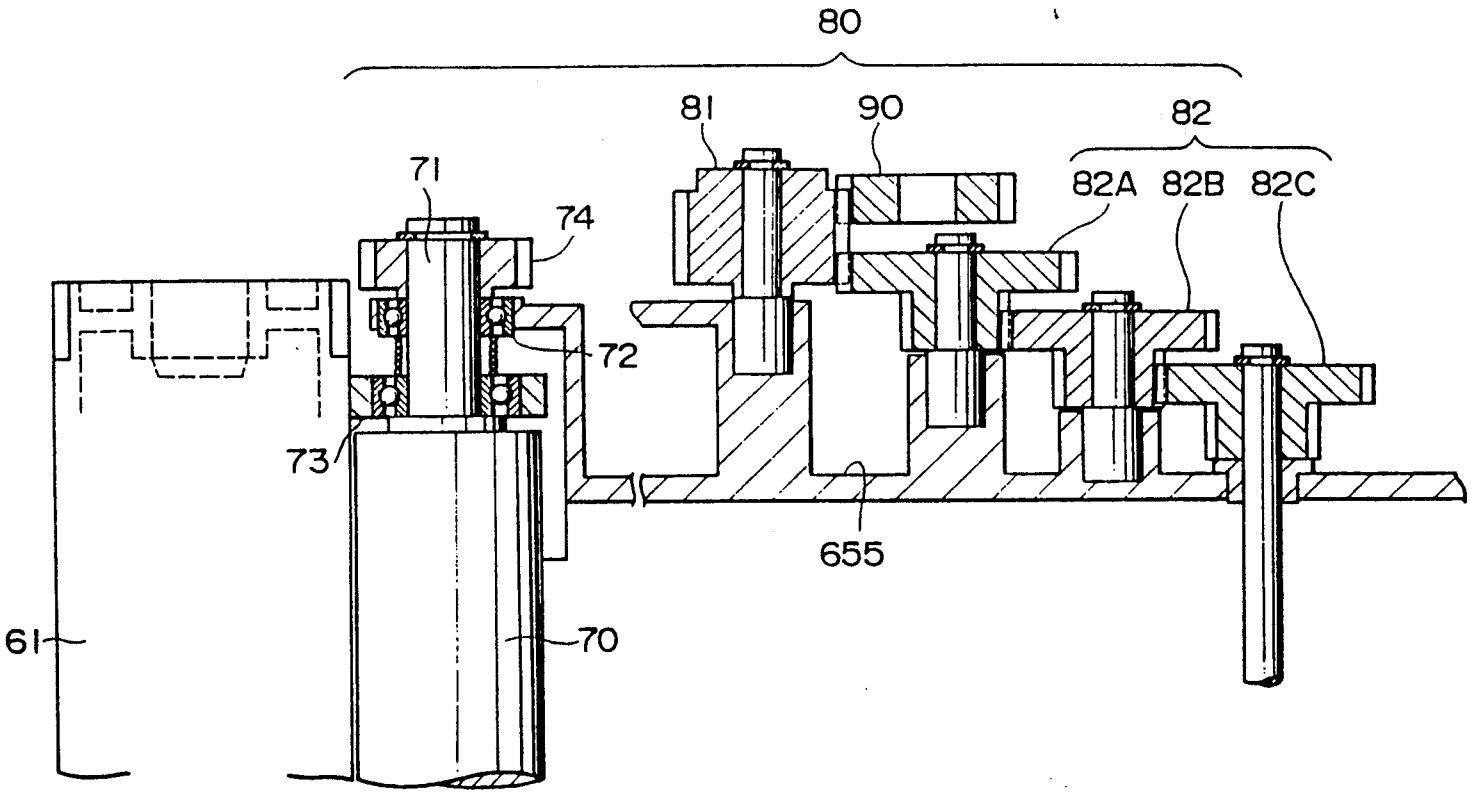
FIG. 5 is a conceptual cross sectional view of the drive force transmission mechanism.

As shown in the conceptual cross sectional view of a drive force transmission mechanism in FIG. 5, the development roller 70 is rotatably supported by the right and left side walls 655 of the housing 650 through the small-diameter end portions 71, 71 of the development roller 70 rotatably supported by bearings 72, 72. The circumferential surface of the development roller 70 is exposed from the opening 656 defined in the housing 650 by a predetermined extent.

Guide rollers 73, each having a radius obtained by adding a development gap to be set to the radius of the development roller 70, are inserted around the periphery of the small-diameter end portions 71, 71 at positions thereof located inwardly of the positions where the portions 71 are supported by the side walls 655, 655 (only one of the guide rollers 73 is shown in FIG. 5).

Further, a roller gear 74 is relatively unrotatably mounted to the position of the small-diameter end portion 71 projecting outwardly from one of the side walls 655.

Figure 4:
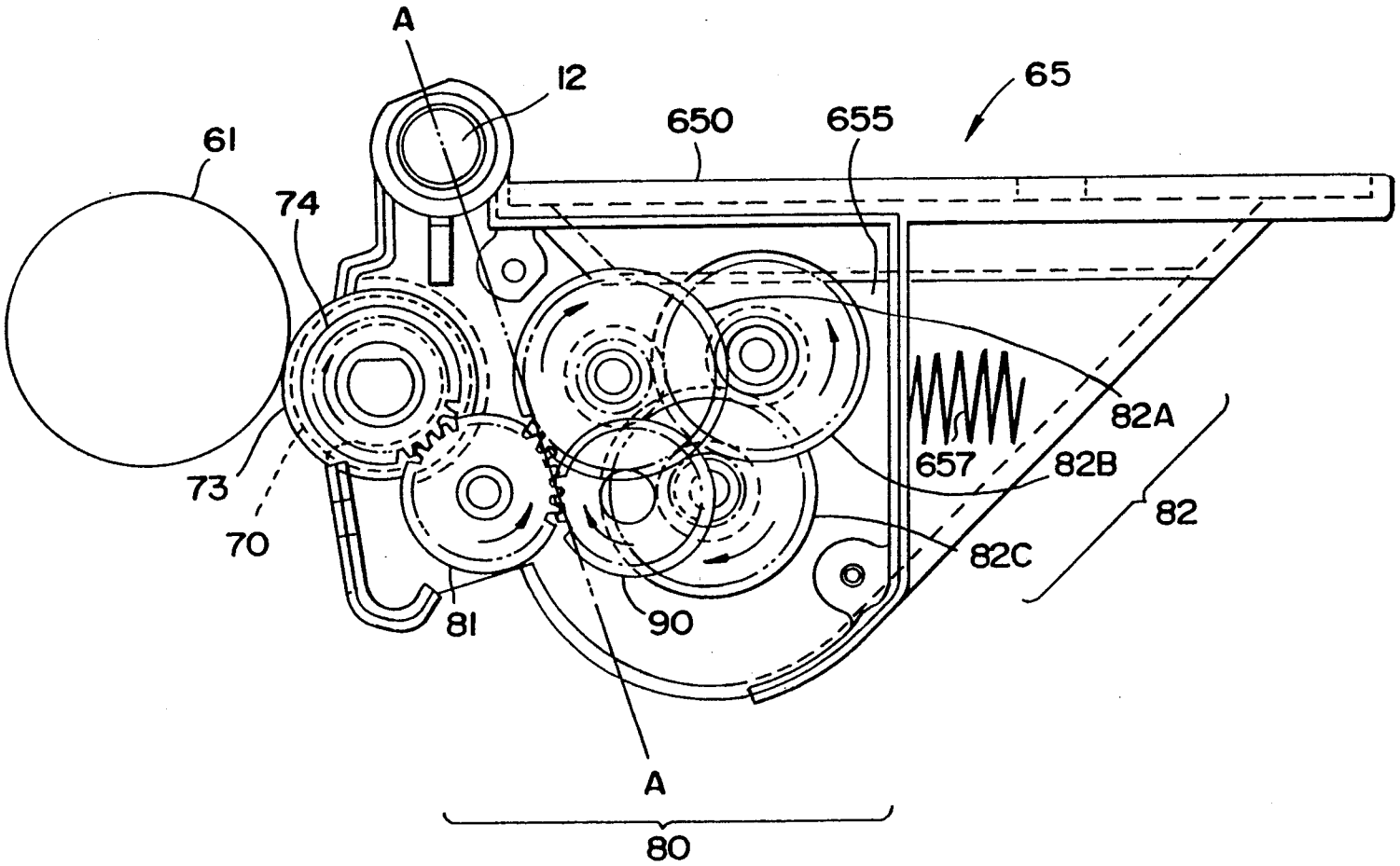
FIG. 4 is a side view of the development unit on the side of a drive force transmission mechanism side.

As shown in FIG. 4, a gear train 80, which includes a plurality of gears meshed to each other, is provided with side wall 655 to which the roller gear 74 is mounted and serves as the drive force transmission mechanism.

The gear train 80 includes input gear 81 rotatably disposed obliquely downwardly of the roller gear 74, the roller gear 74, and the gear 82A of a scraper drive system 82, each of which are meshed with the input gear 81.

The scraper drive system 82 is arranged such that the rotation of the input gear 81 is transmitted to the scraper 653 contained in the toner accommodation vessel 652 at a predetermined reduction ratio through the gear 82A, and gears 82B and 82C.

The development unit 65 arranged as described above is supported by the chassis of the main body 10 through the support shaft 12 so that it can be swung about the support shaft 12. The development roller 70, confronting the photoconductive drum 61, is caused to approach and retract from the photoconductive drum 61 as the development unit 65 is swung. Further, the development roller 70 is swingingly urged to approach the photoconductive drum 61 by a spring 657 attached to the rear side of the development unit 65, and the guide rollers 73, 73 are pressed against the photoconductive drum 61 by a predetermined press force, whereby a predetermined development gap is provided between the circumferential surface of the development roller 70 and the circumferential surface of the photoconductive roller 61.

On the other hand, a drive gear 90 is provided with the main body, to which the development unit 65 is mounted, at the position thereof where the drive gear 90 is meshed with the input gear 81, such that the development unit 65 is set at a predetermined location with the development gap as described above. The drive gear 90 is rotated by a drive source (not shown) provided with the main body, and the input gear 81 is rotated by the drive gear 90.

The input gear 81 and drive gear 90 are formed to have involute teeth and thus the positional relationship of these gears established when they are meshed with each other is set such that a line A—A obtained by extending a line of action as a moving locus of the point where the input gear 81 is in contact with the drive gear 90, passes through the center of the mounting shaft 12. Since the line A—A is the tangential line of the base circles of the input gear 81 and the drive gear 90 (i.e., a line normal to the tangential line of the flank faces of the input gear 81 and drive gear 90 meshed with each other), the direction of the aforesaid tangential line of the base circles coincides with the direction of action of the force applied from the drive gear 90 to the input gear 81 to rotate the same.

With the above arrangement, the drive gear 90 meshes with the input gear 81 in a manner that the development unit 65 is set at the predetermined position and the input gear 81 is rotated by the rotation of the drive gear 90 as shown by arrows in FIG. 4. The rotation of the input gear 81 is transmitted to the roller gear 74 meshed therewith to thereby rotate the development roller 70 at a predetermined r.p.m. Further, the scraper 653 is rotated at a predetermined r.p.m. by the rotational force transmitted to the scraper drive system 82 through the gear 82A meshed with the input gear 81.

When the rotational force of the drive gear 90 is transmitted to the input gear 81, the force of the drive gear 90 for rotating the input gear 81 acts in the direction of the line of action of these gears 81 and 90 (i.e., in the direction of the line A—A). Since, however, the swinging fulcrum point of the development unit 65 (the center of the mounting shaft 12) is on the line A—A obtained by extending the line of action as described above, the above force does not act in the direction along which the development unit 65 is swung. Consequently, even if the drive gear 90 is rotated, any force having an acting direction along which the development unit 65 is swung is not applied thereto, and thus the development gap is not changed due to a change of a force by which the guide rollers 73 are pressed against the photoconductive drum 61.

Note, although the swinging fulcrum point of the development unit 65 is set to completely coincide with the line obtained by extending the line of action of the drive gear 90 and input gear 81, the swinging fulcrum point may be dislocated from the line so long as the rotational force of the drive gear 90 does not adversely affect a component of force acting in the direction along which the development unit 65 is swung.

The present disclosure relates to subject matters contained in Japanese Patent Application No. HEI 3-274422 filed on Jul. 25, 1991, which is expressly incorporated herein by reference in its entirety.

What is claimed is:

1. An arrangement comprising:

a mounting member provided with a movable member swingably supported by a main body of an imaging device and mounted to a predetermined position of said main body; and a drive force transmission means coupled with said movable member and connected to a drive system provided with said main body so that a drive force provided by said drive system is transmitted to said drive force transmission means to drive said movable member, said drive force transmission means and said drive system being disposed such that a direction of action of a force transmitted from said drive system to said drive force transmission means is directed to a swinging fulcrum point at which said mounting member is swingably supported by said main body.

2. The arrangement according to claim 1, wherein said drive force transmission means is connected to said drive system through gears having teeth, and a line obtained by extending a line of action as a moving locus of the point at which said teeth of said gears contact each other is substantially directed to said swinging fulcrum point.

* * * * *

UNITED STATES PATENT AND TRADEMARK OFFICE

CERTIFICATE OF CORRECTION

PATENT NO. : 5,291,242
DATED : March 1, 1994
INVENTOR(S) : M. Takano

It is certified that error appears in the above-indentified patent and that said Letters Patent is hereby corrected as shown below:

Title page, item [56] under "U.S. PATENT DOCUMENTS", add the following items:

| | | | |
|---|---|---|---|
| --- | 5,128,716 | 7/92 | Kita |
| | 5,101,239 | 3/92 | Nishikawa. et al. |
| | 5,091,748 | 2/92 | Morisawa. et al. |
| | 4,984,023 | 1/91 | Yoshida |
| | 4,967,691 | 12/90 | Chikama. et al. |
| | 4,952,974 | 8/90 | Mori |
| | 4,150,892 | 4/79 | Schnall. et al.---. |

Signed and Sealed this

Nineteenth Day of November, 1996

Bruce Lehman

*Attest:*

BRUCE LEHMAN

*Attesting Officer*

*Commissioner of Patents and Trademarks*